US010038268B2

(12) United States Patent
Zhang

(10) Patent No.: US 10,038,268 B2
(45) Date of Patent: Jul. 31, 2018

(54) ELECTRICAL CONNECTOR HAVING IMPROVED CONTACT MODULE AND METHOD FOR MAKING SAME

(71) Applicant: FOXCONN INTERCONNECT TECHNOLOGY LIMITED, Grand Cayman (KY)

(72) Inventor: Jian-Li Zhang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/199,995

(22) Filed: Jul. 1, 2016

(65) Prior Publication Data

US 2016/0359256 A1 Dec. 8, 2016

Related U.S. Application Data

(63) Continuation-in-part of application No. 15/174,001, filed on Jun. 6, 2016.

(30) Foreign Application Priority Data

Jun. 5, 2015 (CN) ..... 2015 1 0301712
Jul. 2, 2015 (CN) ..... 2015 1 0380029

(51) Int. Cl.
*H01R 9/03* (2006.01)
*H01R 13/405* (2006.01)
(Continued)

(52) U.S. Cl.
CPC ..... *H01R 13/405* (2013.01); *H01R 13/504* (2013.01); *H01R 13/6466* (2013.01); *H01R 13/658* (2013.01); *H01R 13/6585* (2013.01); *H01R 23/02* (2013.01); *H01R 23/688* (2013.01); *H01R 24/60* (2013.01)

(58) Field of Classification Search
CPC ..... H01R 13/658; H01R 13/6585; H01R 23/688; H01R 13/504; H01R 23/02; H01R 13/6466
(Continued)

(56) References Cited

U.S. PATENT DOCUMENTS 7,540,782 B2 * 6/2009 Takahashi ..... G06K 7/0021 439/630
8,109,795 B2 2/2012 Lin et al.
(Continued)

FOREIGN PATENT DOCUMENTS

CN 201904481 7/2011
CN 102856684 1/2013
(Continued)

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

An electrical connector includes a number of first contacts and a number of second contacts, an insulative housing, a shielding plate, and a metallic shell. The insulative housing has a base portion, a tongue portion, and a number of receiving grooves running through the base portion to the tongue portion. The tongue portion defines a first surface and a second surface. The receiving grooves are exposed on the first surface and the second surface. The insulative housing, the second contacts, and the shielding plate are insert-molded to form a contact module, and the first contacts are assembled to the receiving grooves.

12 Claims, 30 Drawing Sheets

(51) Int. Cl.

| | |
|---|---|
| *H01R 24/60* | (2011.01) |
| *H01R 13/6585* | (2011.01) |
| *H01R 13/658* | (2011.01) |
| *H01R 24/00* | (2011.01) |
| *H01R 12/50* | (2011.01) |
| *H01R 13/6466* | (2011.01) |
| *H01R 13/504* | (2006.01) |

(58) Field of Classification Search
USPC ..... 439/660, 676, 607.58, 607.05
See application file for complete search history.

(56) References Cited

U.S. PATENT DOCUMENTS

| | | | | |
|---|---|---|---|---|
| 8,684,769 | B2 | 4/2014 | Kao et al. | |
| 2010/0248517 | A1 | 9/2010 | Li et al. | |
| 2013/0178110 | A1 | 7/2013 | Xie et al. | |
| 2015/0270661 | A1 | 9/2015 | Kao et al. | |
| 2016/0020568 | A1* | 1/2016 | Ju ..... | H01R 24/78 439/607.01 |

FOREIGN PATENT DOCUMENTS

| | | | |
|---|---|---|---|
| CN | 103296510 | | 9/2013 |
| CN | 203631831 | | 6/2014 |
| CN | 203859329 | | 10/2014 |
| CN | 203859329 | U * | 10/2014 |
| CN | 203942066 | | 11/2014 |
| CN | 204216260 | | 3/2015 |
| CN | 204289872 | | 4/2015 |
| CN | 204333335 | | 5/2015 |
| TW | M494402 | | 1/2015 |
| TW | M500370 | | 5/2015 |
| TW | M504375 | | 7/2015 |

* cited by examiner

ELECTRICAL CONNECTOR HAVING IMPROVED CONTACT MODULE AND METHOD FOR MAKING SAME

BACKGROUND OF THE INVENTION

1. Field of the Invention

The present invention relates generally to an electrical connector, and more particularly to an electrical connector adapted for normally and reversely mating with a mating connector and a method of making the same.

2. Description of Related Arts

China Patent No. 203859329, published on Oct. 1, 2014, discloses an electrical connector comprising a first module group, a second module group, an inner shielding casing, and an outer shielding casing. The first module group comprises a first insulating part, a plurality of first conductive terminals, and a grounding metal sheet. The first insulating part comprises a tongue portion with opposite first and second surfaces and a plurality of terminal accommodating grooves formed in the second surface. The second module group comprises a second insulating part and a plurality of second conductive terminals embedded in the second insulating part. The first insulating part and the second insulating part are combined together to form an insulating body.

An improved electrical connector is desired.

SUMMARY OF THE INVENTION

An object of the present invention is to provide an electrical connector which is easy to make.

To achieve the above-mentioned object, an electrical connector includes: a plurality of contacts having a plurality of first contacts and a plurality of second contacts, each first contact having a first engaging section and each second contact having a second engaging section; an insulative housing having a base portion, a tongue portion extending forwardly from the base portion and a plurality of receiving grooves running through the base portion to the tongue portion in an front-and-rear direction, the tongue portion defining a first surface and a second surface corresponding with the first surface in an up-and-down direction perpendicular to the front-and-rear direction, the receiving grooves exposed on the first surface and the second surface; a shielding plate sandwiched between the first engaging sections and the second engaging sections; a metallic shell enclosing the insulative housing; wherein the insulative housing, the second contacts and the shielding plate are insert-molded to form a contact module, and the first contacts are assembled to the receiving grooves.

Other objects, advantages and novel features of the invention will become more apparent from the following detailed description when taken in conjunction with the accompanying drawings.

DETAILED DESCRIPTION OF THE PREFERRED EMBODIMENT

Figure 1:
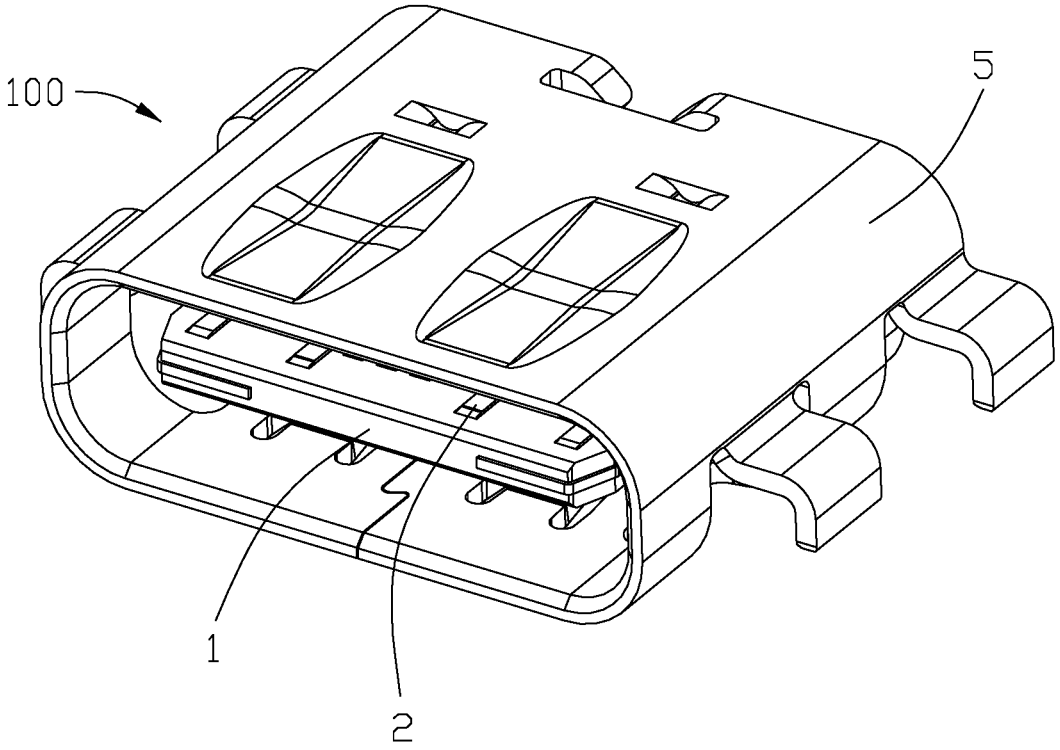
FIG. 1 is a perspective, assembled view of an electrical connector in accordance with the present invention.
Figure 2:
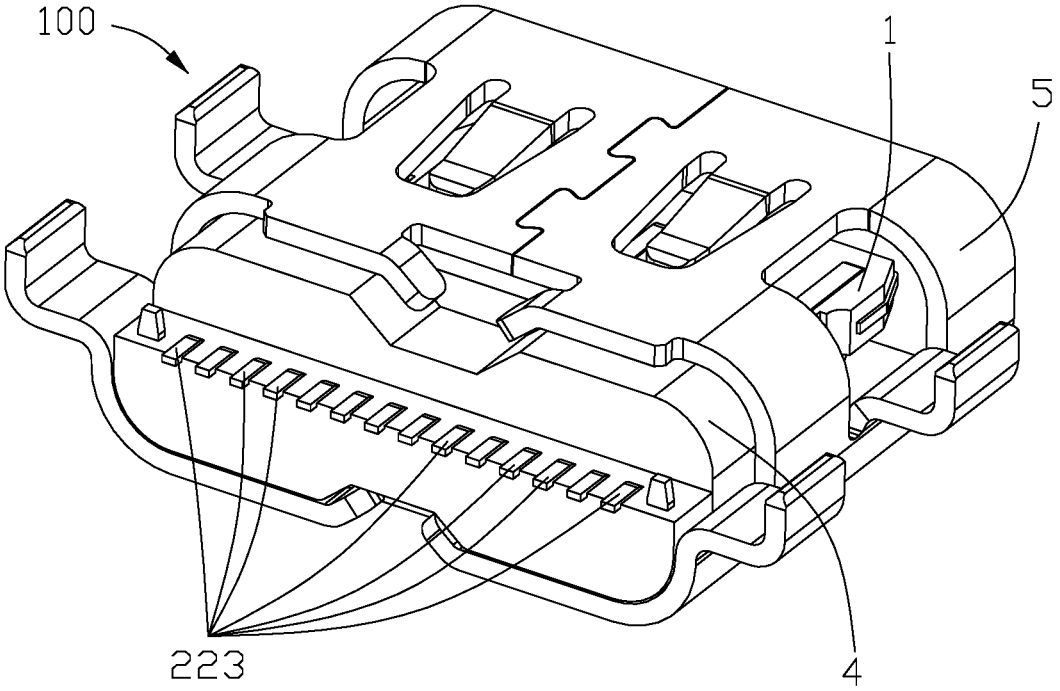
FIG. 2 is a view similar to FIG. 1, but viewed from another aspect.
Figure 3:
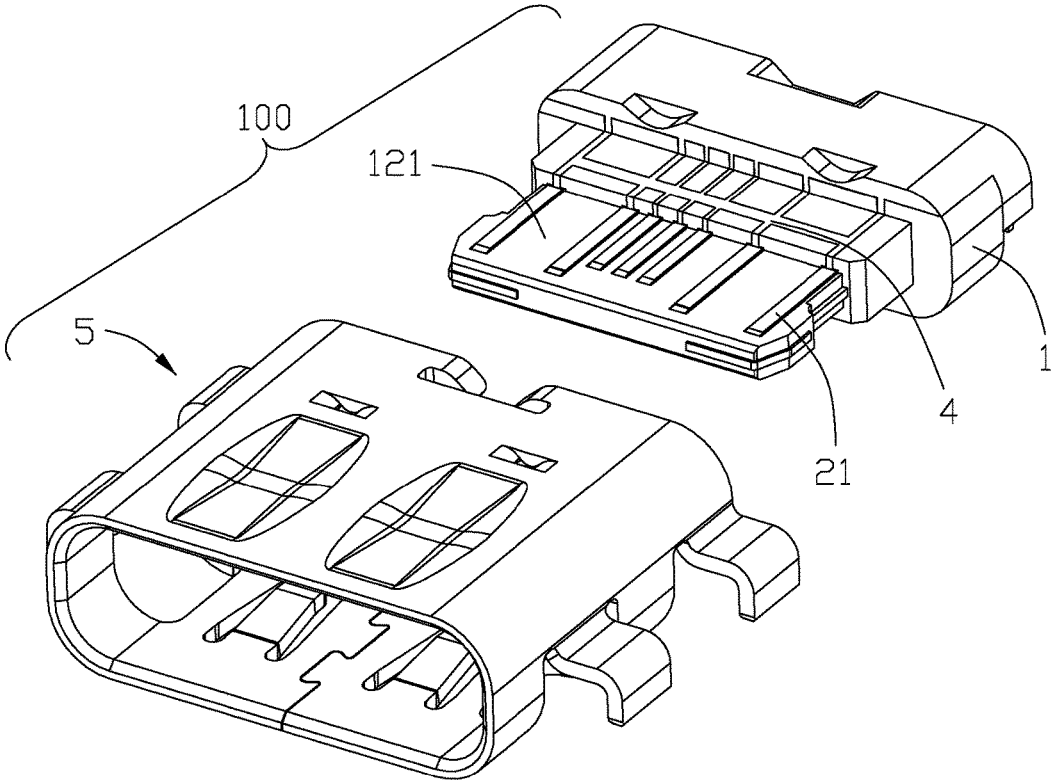
FIG. 3 is a partially exploded view of the electrical connector shown in FIG. 1.
Figure 4:
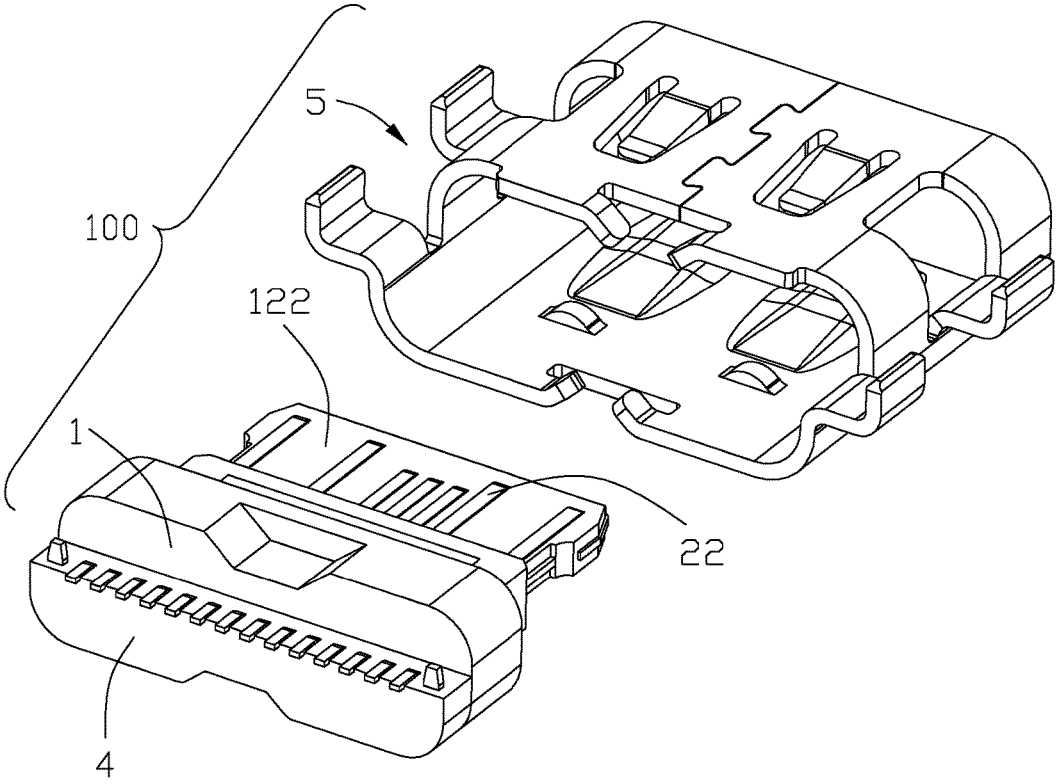
FIG. 4 is a view similar to FIG. 3, but viewed from another aspect.
Figure 5:
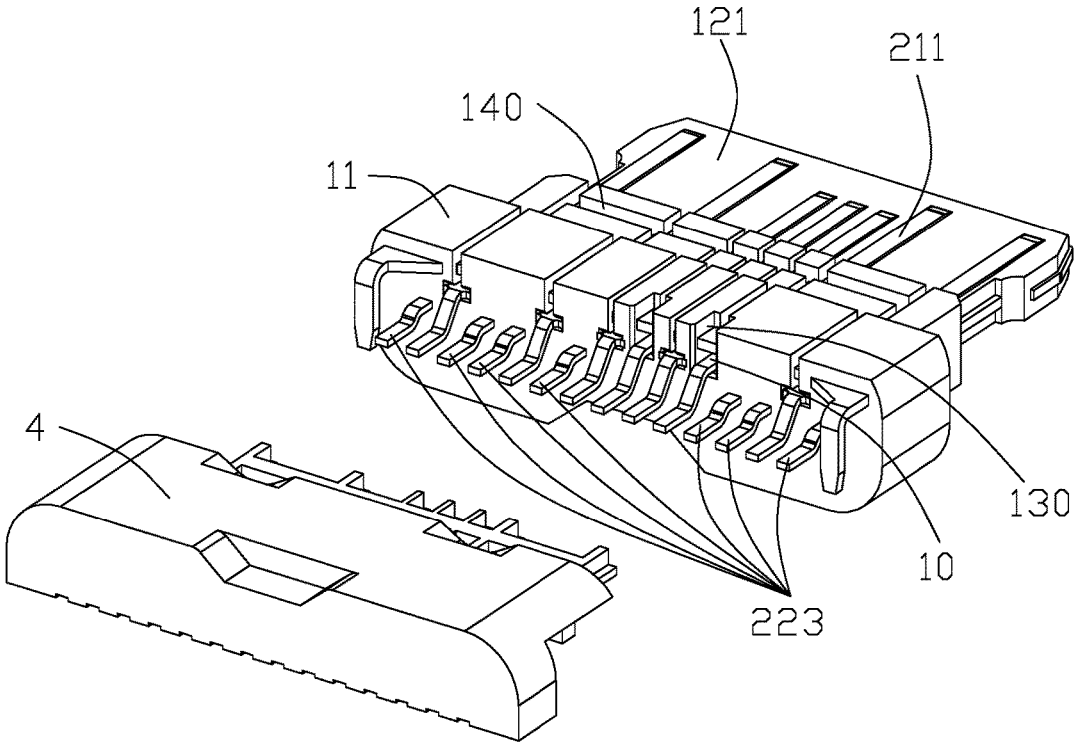
FIG. 5 is a perspective, assembled view of the electrical connector omitting a metallic shell and an insulative member.

Referring to FIGS. 1-10, the electrical connector 100 in accordance with the present invention comprises an insulative housing 1, a plurality of contacts 2 accommodated in the insulative housing 1, a shielding plate 3 accommodated in the insulative housing 1, an insulative member 4 attached to the insulative housing 1 and a metallic shell 5 enclosing the insulative housing 1.

As shown in FIGS. 3-9, the insulative housing 1 comprises a base portion 11, a tongue portion 12 extending forwardly from the base portion 11 and a plurality of receiving grooves 10 running through the base portion 11 to the tongue portion 12 in an front-and-rear direction. The base portion 11 comprises a rear portion 13 and a connecting portion 14 around the root section (not labeled) of the tongue portion 12 and connecting the tongue portion 12 and the rear portion 13. Thicknesses of the rear portion 13, the connecting portion 14 and the tongue portion 12 are decreasing gradually so as to form a step structure. The connecting portion 14 defines a large through hole 140 running through the connecting portion 14 in an up-and-down direction perpendicular to the front-and-rear direction for containing a mold insert (not shown) to resist the contacts 2. The tongue portion 12 defines a first surface 121, a second surface 122 corresponding with the first surface 121 in the up-and-down direction and a plurality of receiving grooves 10. The base portion 11 defining a plurality of slots 130 connecting with the receiving grooves 10 in the up-and-down direction and exposed on an upper surface (not numbered) or a lower surface (not numbered) thereof;

The contacts 2 comprise a plurality of first contacts 21 accommodated in the first surface 121 of the insulative housing 1 and a plurality of second contacts 22 accommodated in the second surface 122 of the insulative housing 1. Each first contact 121 comprises a first engaging/contacting section 211 exposed on the first surface 121, a first soldering/tail section 213 exposed out of the insulative housing 1 and a first connecting section 212 connecting the first engaging section 211 and the first soldering section 213. Each first engaging section 211 of the first contacts 21 is positioned in reverse symmetry with respect to a respective one of the second contacts 22. The first connecting section 212 comprises a holding section (not numbered) extending to two sides from a position close to the first soldering section 213. The holding section resists on a rear end of the receiving grooves 10 of the first surface 121. Each second contact 22 comprises a second engaging/contacting section 221 exposed on the second surface 122 of the tongue portion 12, a second soldering/tail section 223 exposed out of the insulative housing 1 and a second connecting section 222 connecting the second engaging section 221 and the second soldering section 223. The first soldering sections 213 and the second soldering sections 223 are arranged in a row in the horizontal direction perpendicular to the up-and-down direction. Each first contact 21 comprises a forestalling section 210 sloping downwardly from a free end of the first engaging section 211 and each second contact 22 comprises a forestalling section 220 sloping upwardly from a free end of the second engaging section 221. The forestalling sections 210, 220 are fixed in the tongue portion 12 for preventing the contacts 2 from warping.

The first contacts 21 and the second contacts 22 comprise two grounding contacts, two power contacts located between the two grounding contacts and two signal contacts located between the two power contacts, respectively. A front surface of the engaging sections of the two grounding contacts and the two power contacts is closer to a front surface of the insulative housing than the engaging sections of the signal contacts. The three signal contacts comprise a high-speed signal contact, a low-speed signal contact and a control contact between the high-speed signal contact and a low-speed signal contact.

As shown in FIGS. 2-5, the shielding plate 3 comprises a supporting portion 31 sandwiched between the first surface 121 and the second surface 122, a retaining portion 32 accommodated in the base portion 11, a ramp portion 34 connecting the supporting portion 31 and the fixed portion 32, a fixing portion 33 bent downwardly from a rear edge of the retaining portion 32, a mouth 30 surrounded by the supporting portion 31, the retaining portion 32 and the fixed portion 34 and a plurality of openings or apertures 35 corresponding with the through hole 140. In the present invention, the insulative housing 1, the second contacts 22 and the shielding plate 3 are insert-molded to form a contact module (not numbered), and the first contacts 21 are assembled to the receiving grooves 10. While the second contacts 22 and the insulative housing 1 are molded by insert-molding process, a mold insert or core pins (not shown) resists a plurality of beltings or bridges 229 linked between the neighboring second contacts 22 through the through hole 140 and the openings 35 so as to retain the second contacts 32 in position during the insert-molding process. After the second contacts 22 and the insulative housing 1 are molded together, the bridges 229 should be removed by punching so as to have each contact work independently.

Figure 6:
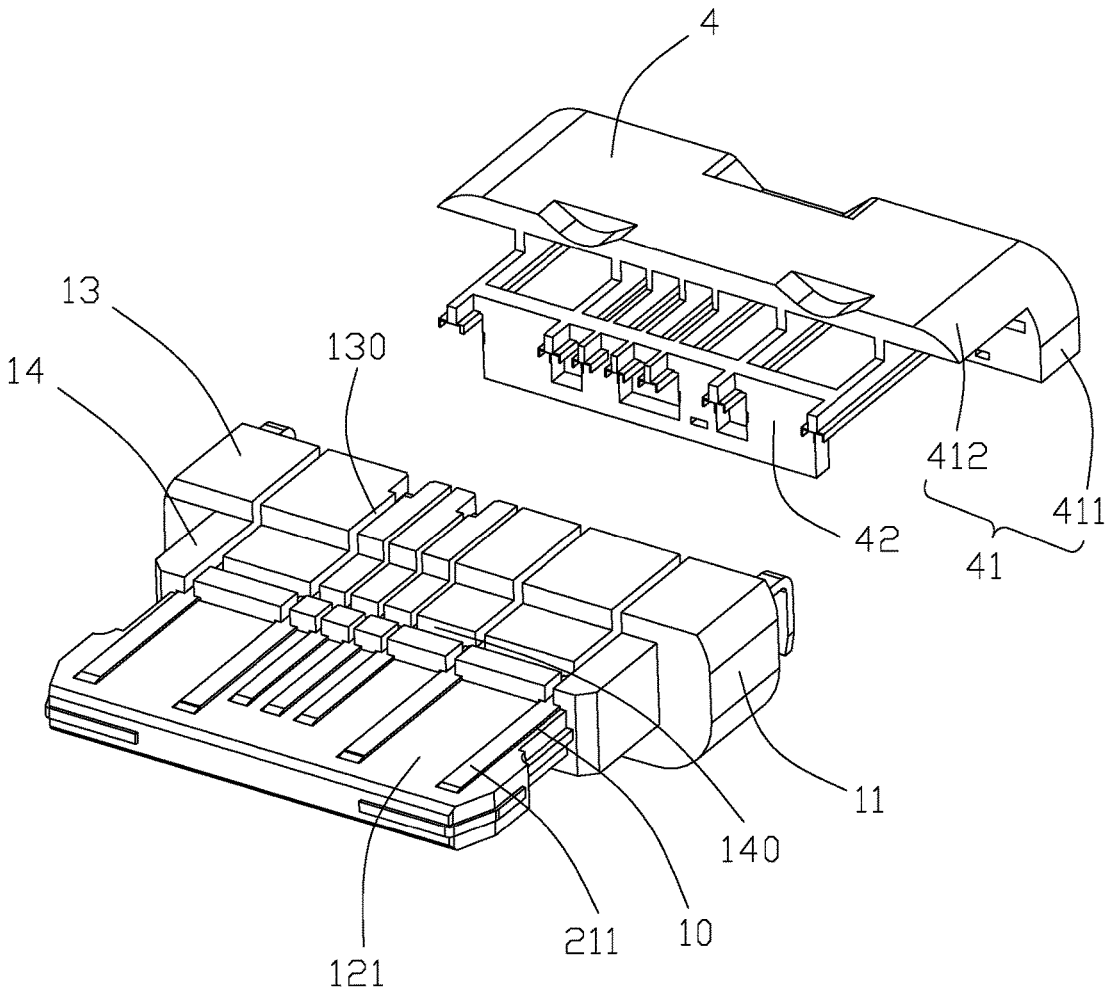
FIG. 6 is a view similar to FIG. 5, but viewed from another aspect.
Figure 7:
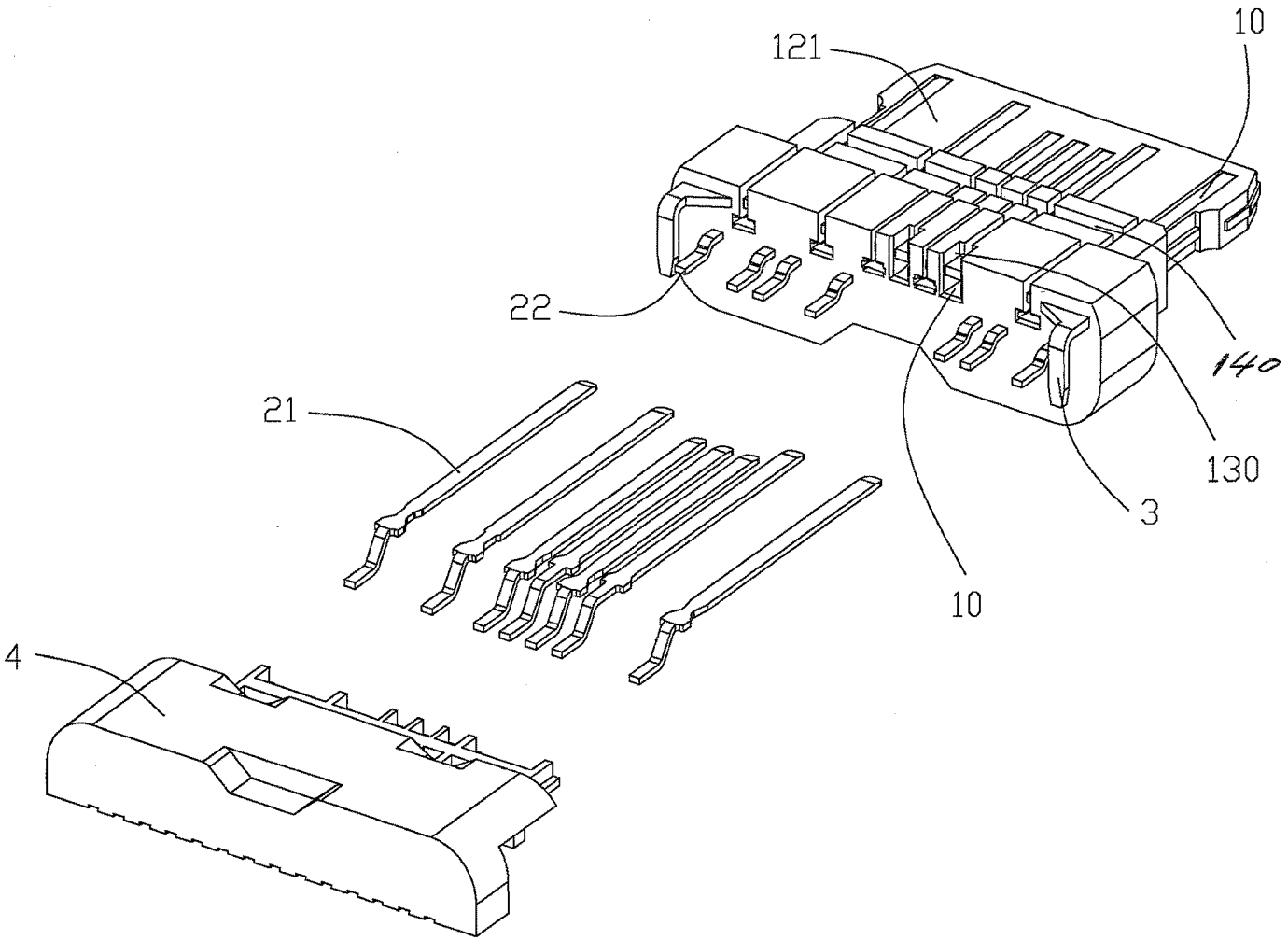
FIG. 7 is a perspective, assembled view of the electrical connector in FIG. 5 omitting a first contact.
Figure 8:
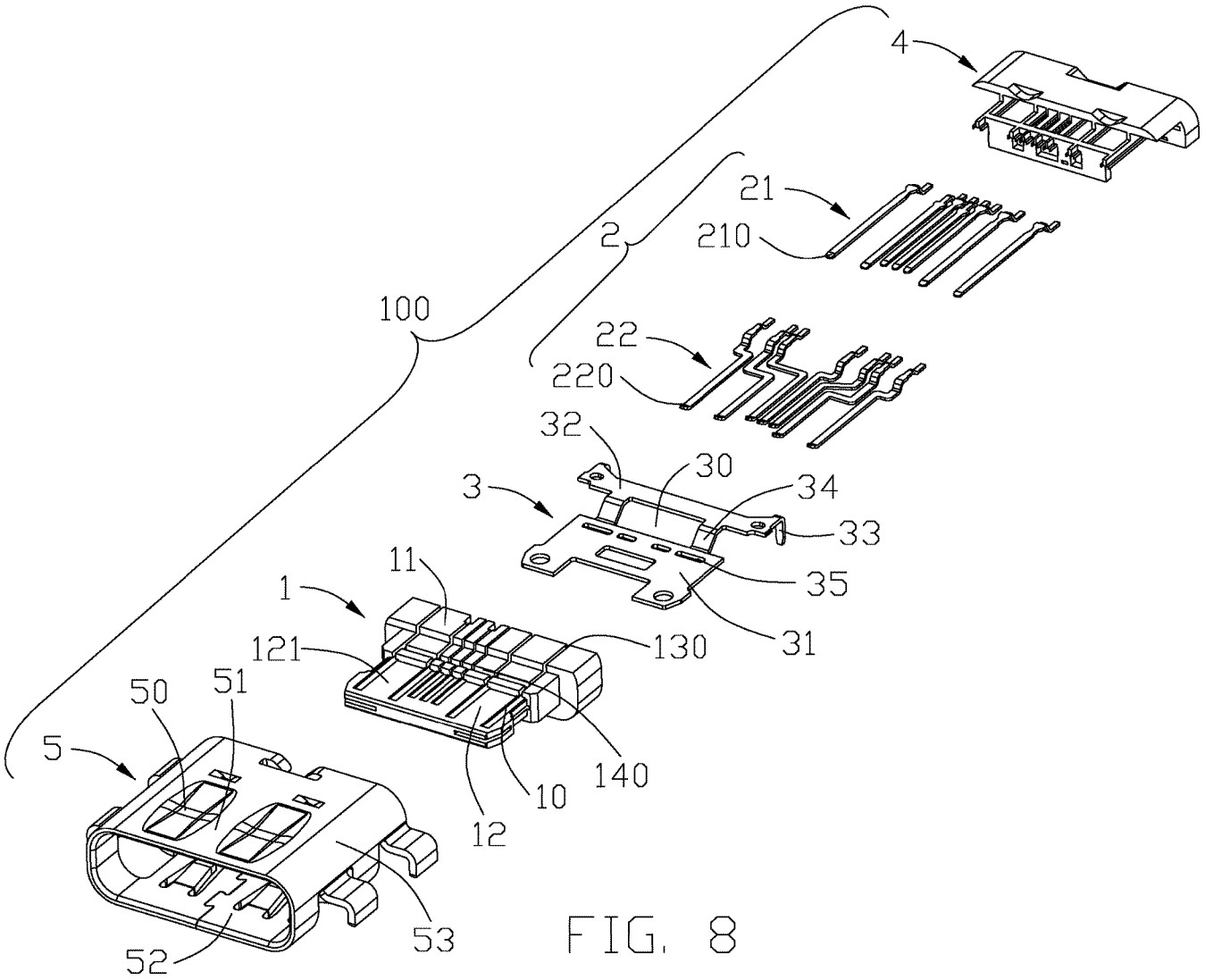
FIG. 8 is a perspective, exploded view of the electrical connector.
Figure 9:
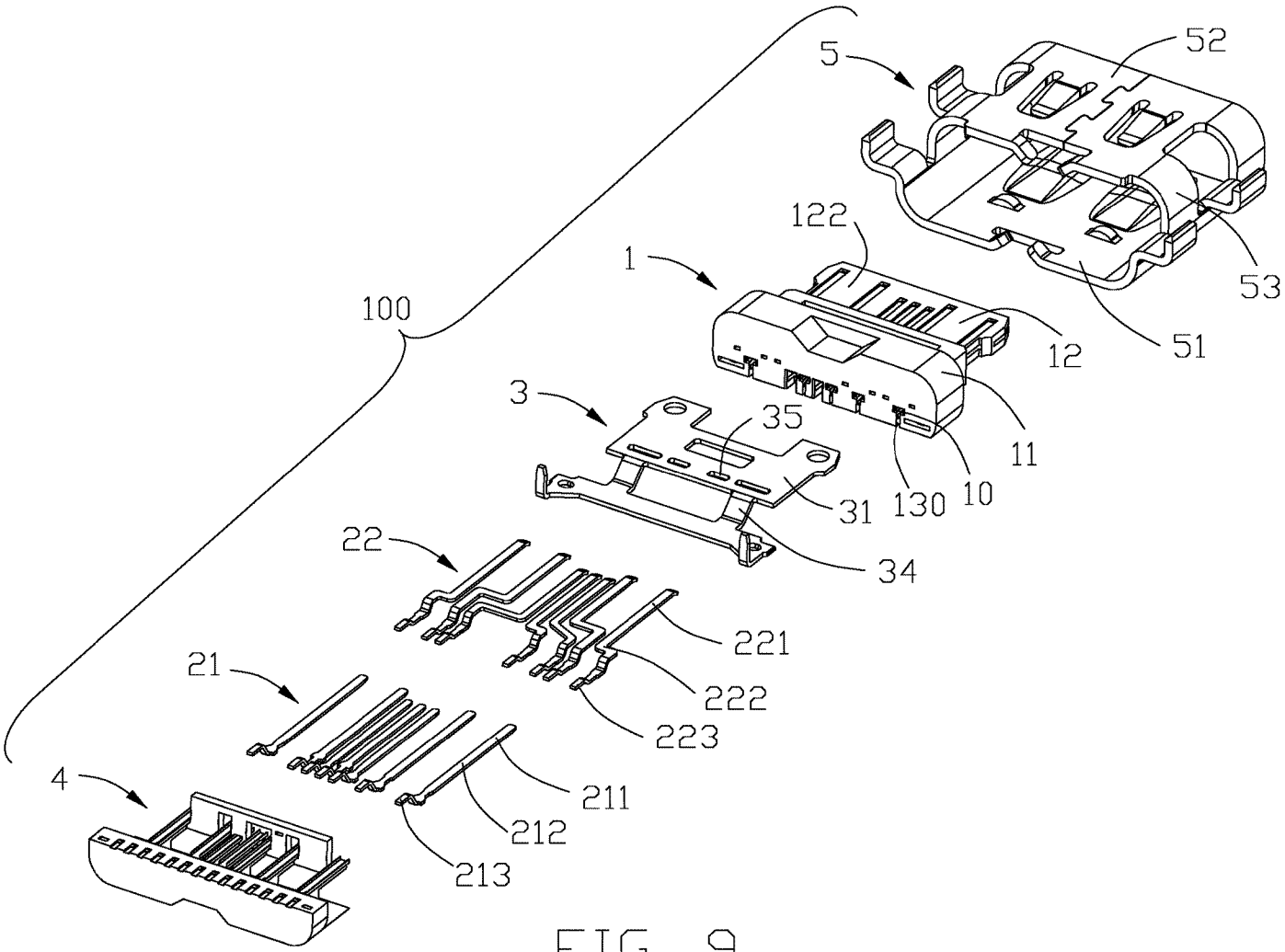
FIG. 9 is a view similar to FIG. 8, but viewed from another aspect.
Figure 10:
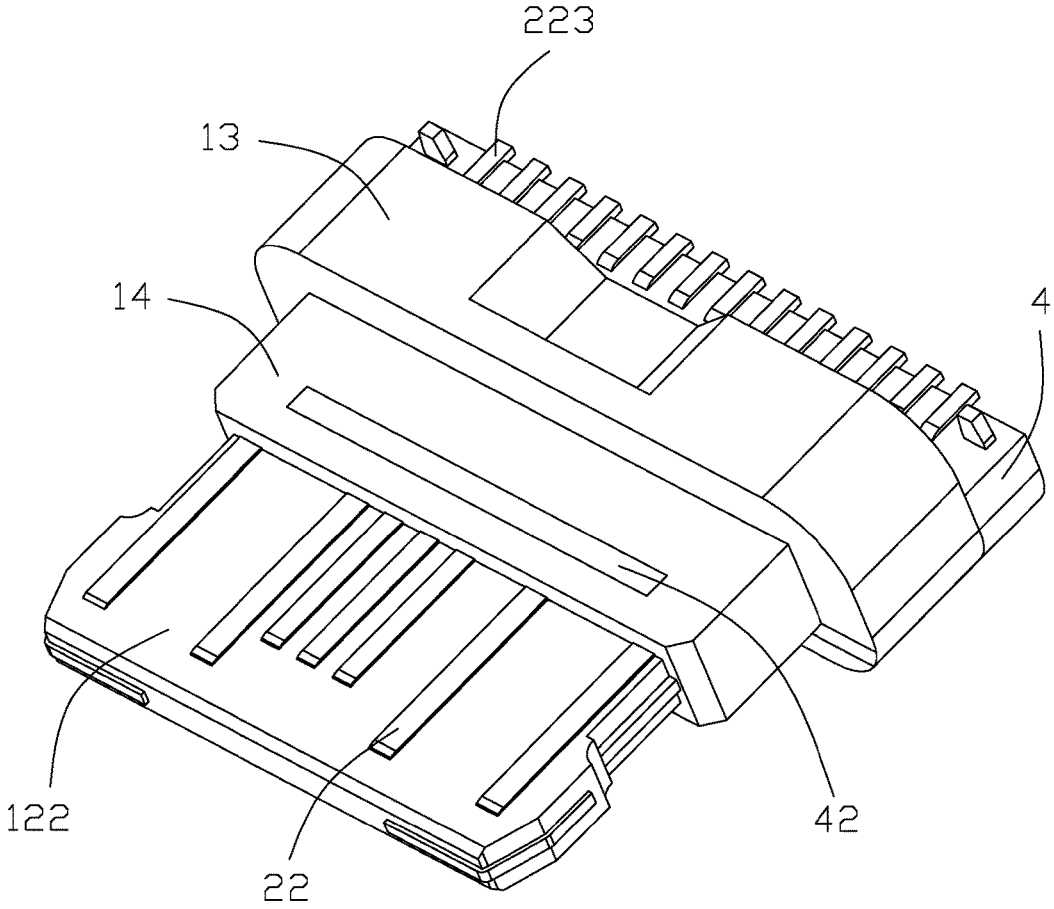
FIG. 10 is a perspective, assembled view of the electrical connector shown in FIG. 2 without the metallic shell.
Figure 11:
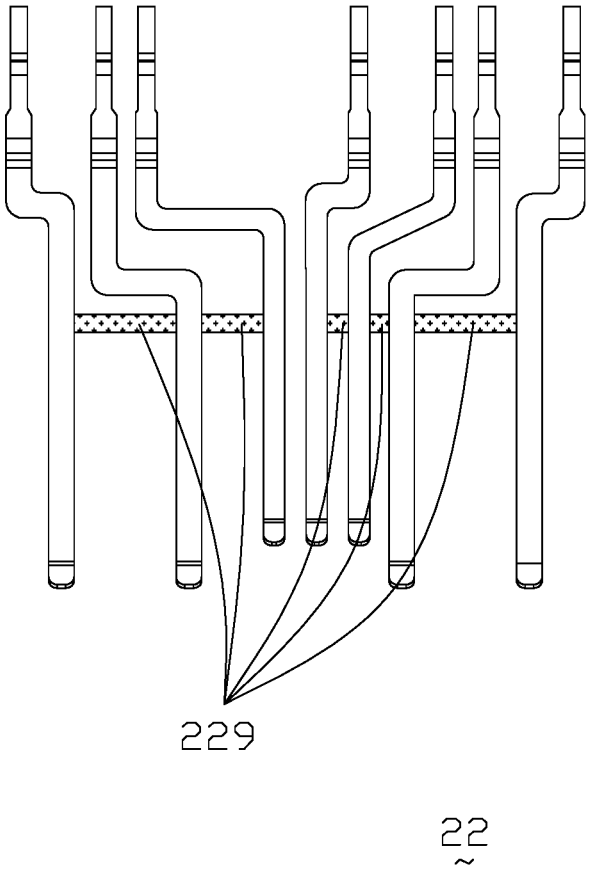
FIG. 11 is a plan view to show the second contacts with a plurality of bridges linked between the neighboring second contacts.
Figure 12:
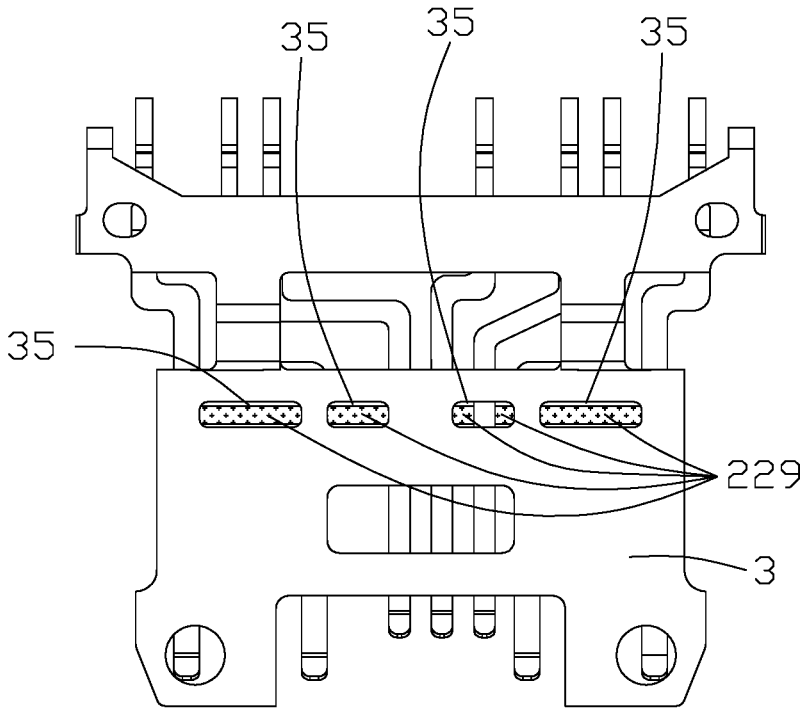
FIG. 12 is a plan view to show the second contacts with a plurality of bridges linked between the neighboring second contacts of FIG. 11 and further with the shielding plate therabove to show the alignment between the bridges and the openings in the shielding plate in the vertical direction.
Figure 13:
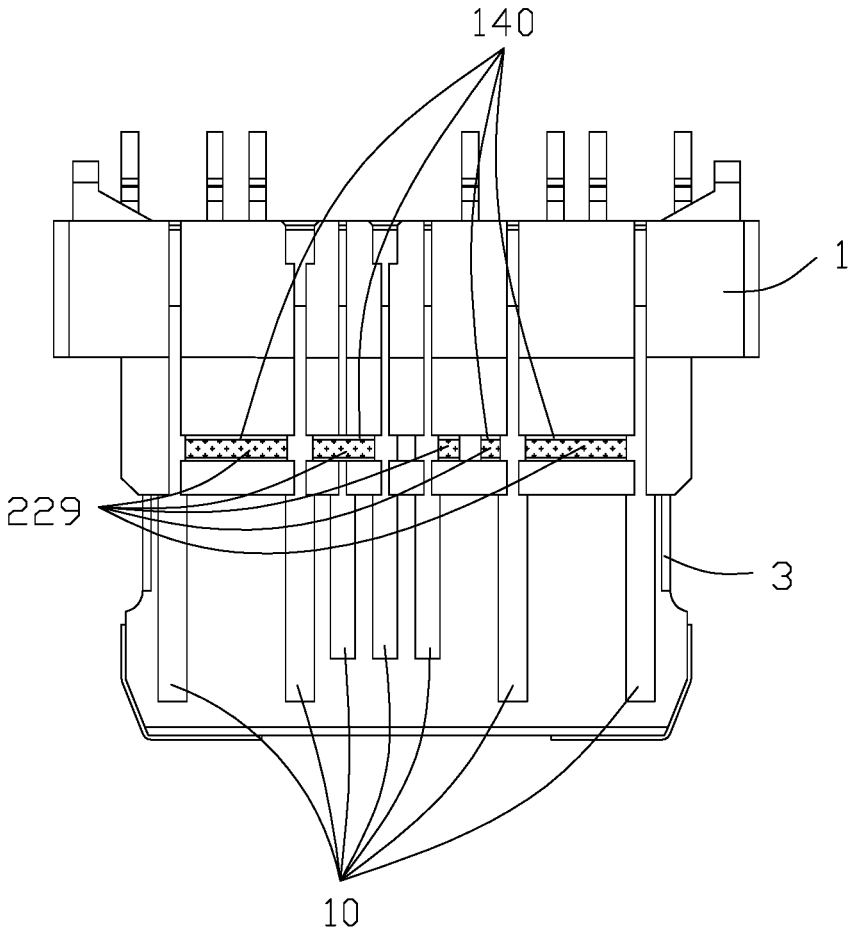
FIG. 13 is a plan view to show the second contacts with a plurality of bridges linked between the neighboring second contacts and the associated shielding plate of FIG. 12, and further with the housing to show how the bridges are exposed to an exterior through the through hole of the housing and the corresponding openings of the shielding plate.
Figure 13A:
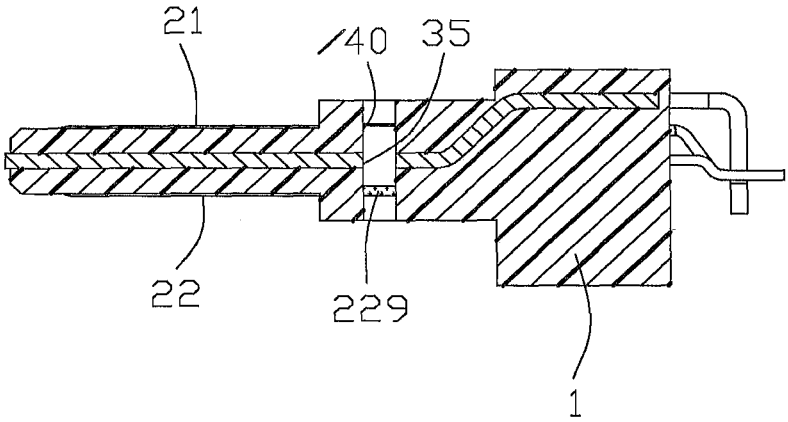
FIG. 13(A) is a cross-sectional view of the assembly of FIG. 13 wherein the first contacts are also further shown for easy comparison.
Figure 13B:
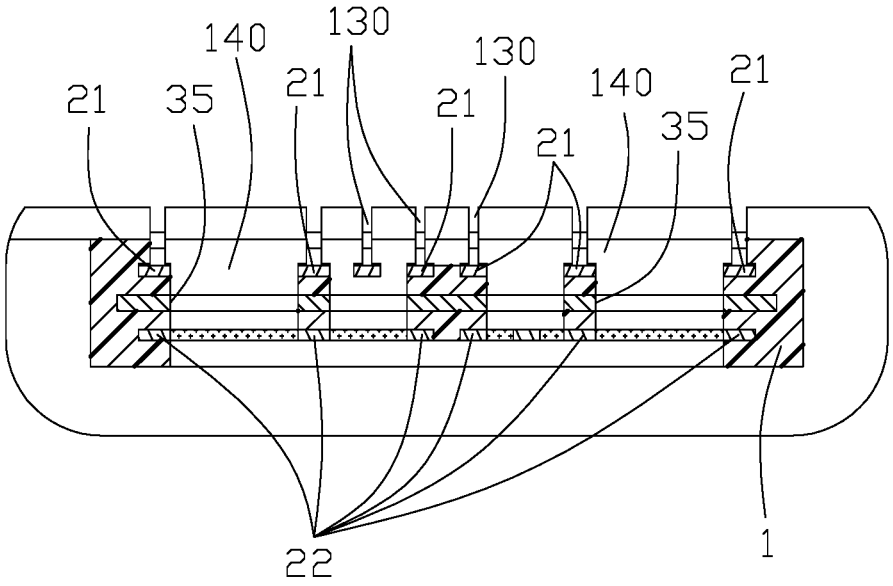
FIG. 13(B) is another cross-sectional view of the assembly of FIG. 13(A)
Figure 14:
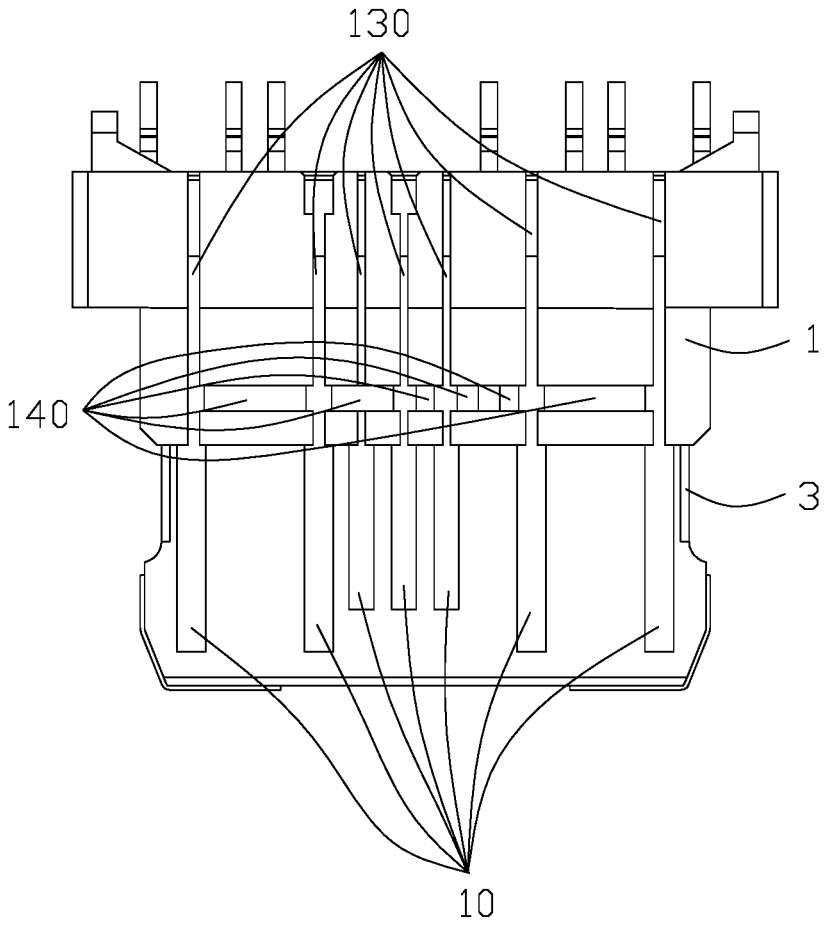
FIG. 14 is a plan view of to show an assembly of FIG. 13 including the second contacts and the shielding plate integrally formed by the housing wherein the bridges have been removed.
Figure 15A:
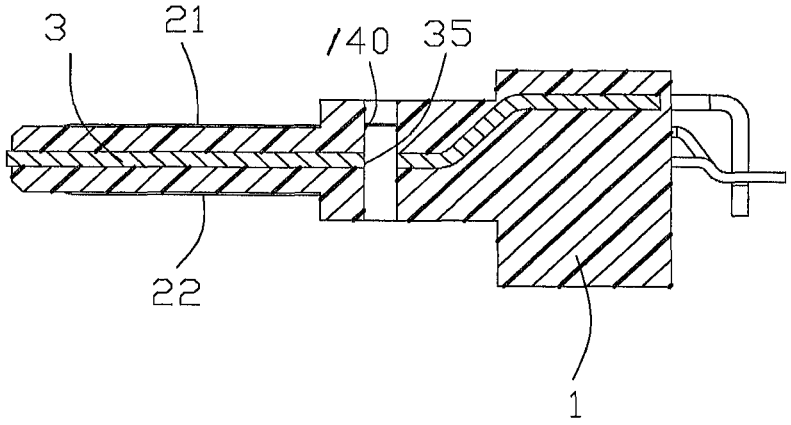
FIG. 15(A) is a cross-sectional view of the assembly of FIG. 14 wherein the first contacts are also further shown for easy comparison.
Figure 15B:
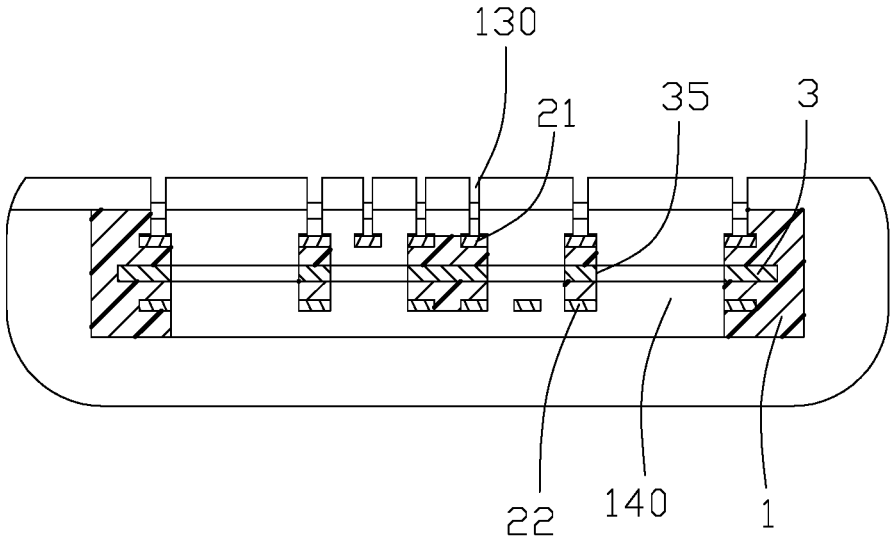
FIG. 15(B) is another cross-sectional view of the assembly of FIG. 15(B)

As shown in FIG. 6, the insulative member 4 comprises a covering portion 41 covering the rear portion 13 and a sealing portion 42 sealing the connecting portion 14. The covering portion 41 comprises a rear covering portion 411 covering a rear end of the rear portion 13 and a top covering portion 412 covering an upper end of the rear portion 13. The rear covering portion 411 wraps parts of the first connecting section 212 and the second connecting section 222 exposed out of the rear portion 13. The top covering portion 412 seals the slots 130 and the receiving grooves 10 located in the rear portion 13. The sealing portion 42 seals the slots 130, the receiving grooves 10 and the through hole 140 located in the connecting portion 14. The insulative member 4 wraps the first connecting section 212 and a part of the second connecting section 222 exposed out of the rear portion 13 for fastening the contacts 2. It should be noted that in the description, both the first contacts 21 and the second contacts 22 are received in the corresponding receiving grooves 10 even though the first contacts 21 are assembled into the housing 1 while the second contacts are integrally formed with the housing 1 via the insert-molding process. It is because the housing 1 is essentially formed with the corresponding grooved structure to receive the corresponding second contacts 22 from the technical viewpoint.

As shown in FIGS. 1-5, the metallic shell 5 comprises an upper wall 51 and a lower wall 52 and a pair of side walls 53. The upper wall 51 comprises a plurality of concave block 50 sunken downwardly from the upper wall 51 for connecting with a mating connector (not shown). While connecting the electrical connector 100 with the mating connector, the concave block 50 resists a metallic shell of the mating connector so as to enhance a waterproof function.

As shown in FIGS. 1-10, a method of making the electrical connector 100 comprises the steps of providing a plurality of second contacts 22 and a shielding plate 3 and insert-molding an insulative housing 1 with the second contacts 22 and the shielding plate 3. The insulative housing 1 comprises a base portion 11 and a tongue portion 12 extending forwardly from the base portion 11 and a plurality of receiving grooves 10 running through the base portion 11 to the tongue portion 12. The tongue portion 12 defines a first surface 121, a second surface 122 corresponding with the first surface 121 in an up-and-down direction and the receiving grooves 10 exposed on the first surface 121 and the second surface 122. The rear portion 13 defines a plurality of slots 130 exposed on an upper surface or a lower surface of the base portion 11 and connecting with the receiving grooves 10 in the up-and-down direction. The base portion 11 comprises a rear portion 13 and a connecting portion 14 connecting the rear portion 13 and the tongue portion 12. The connecting portion 14 defines a through hole 140 miming through the connecting portion 14 in the up-and-down direction and connecting with the receiving grooves 10. The method further includes steps of inserting a plurality of second contacts 22 into the receiving grooves 10 exposed on the second surface 122 and over-molding an insulative member 4 to the insulative housing 1 for sealing the slots 130, the receiving grooves 10 and the through hole 140; assembling a shielding shell 5 to enclose the insulative housing 1. The step of providing the shielding plate comprises defining a plurality of openings 35 corresponding with the through hole 140 in the shielding plate for enabling a mold insert or core pin (not shown) to resist a plurality of bridges 229 linked between the neighboring second contacts 22 through the through hole 140 and the openings 35 so as to retain the second contacts 32 in position during the insert-molding process. Understandably, such bridges 229 should be removed by punching through the through hole 140 and the openings 35 in the vertical direction after the contacts 22, the housing 1 and the shielding plate 3 are integrally formed together by the insert-molding process so as to assure each second contact 22 is not improperly linked by its neighbors and may work independently. Notably, before being removed from the neighboring second contacts 22, the bridges 229 are used to not only keep the neighboring second contacts 22 in the correct positions in the transverse direction but also allow the mold insert or core pines to supportably press thereon in the vertical direction so as to have the linked second contacts 22 in position in the vertical direction during the high pressure insert-molding process, thus assuring the correct positions of the second contacts regard to the housing 1 after the insert-molding process. It should be noted that the through hole 140 and the openings 35 are required to be aligned with the corresponding bridges 229 in the vertical direction for allowing the puncher (not shown) to move therethrough in the vertical direction for removing the bridges 229 after the insert-molding process. Understandably, in this embodiment only one large through hole 140 is suggested. Anyhow, breaking such a large through opening into several small openings is also workable.

Figure 16A:
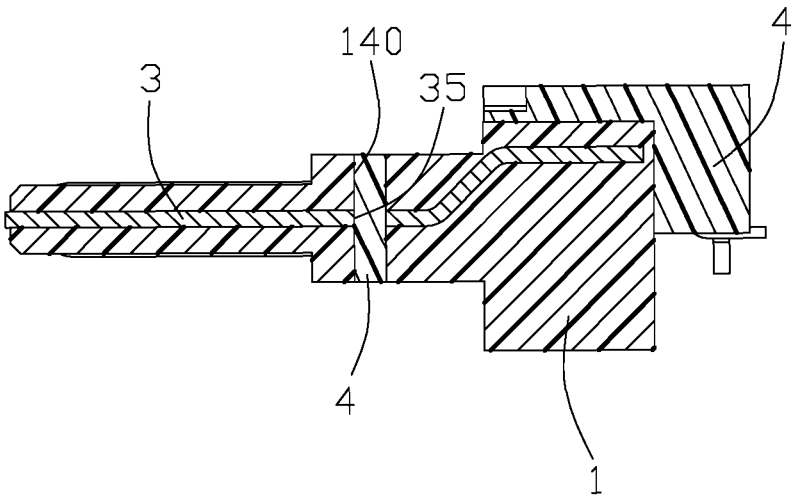
FIG. 16(A) is a cross-sectional view of the assembly of FIG. 15(A) with the insulative member applied thereon.
Figure 16B:
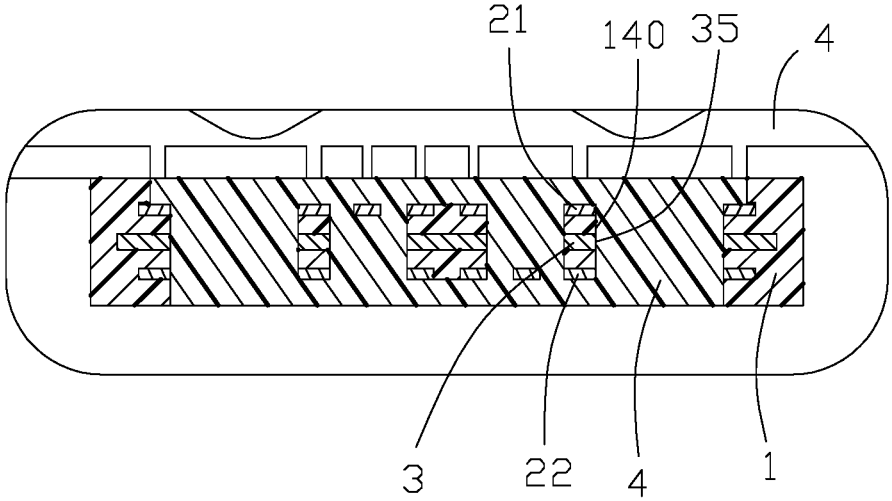
FIG. 16(B) is another cross-sectional view of the assembly of FIG. 16(A)
Figure 17:
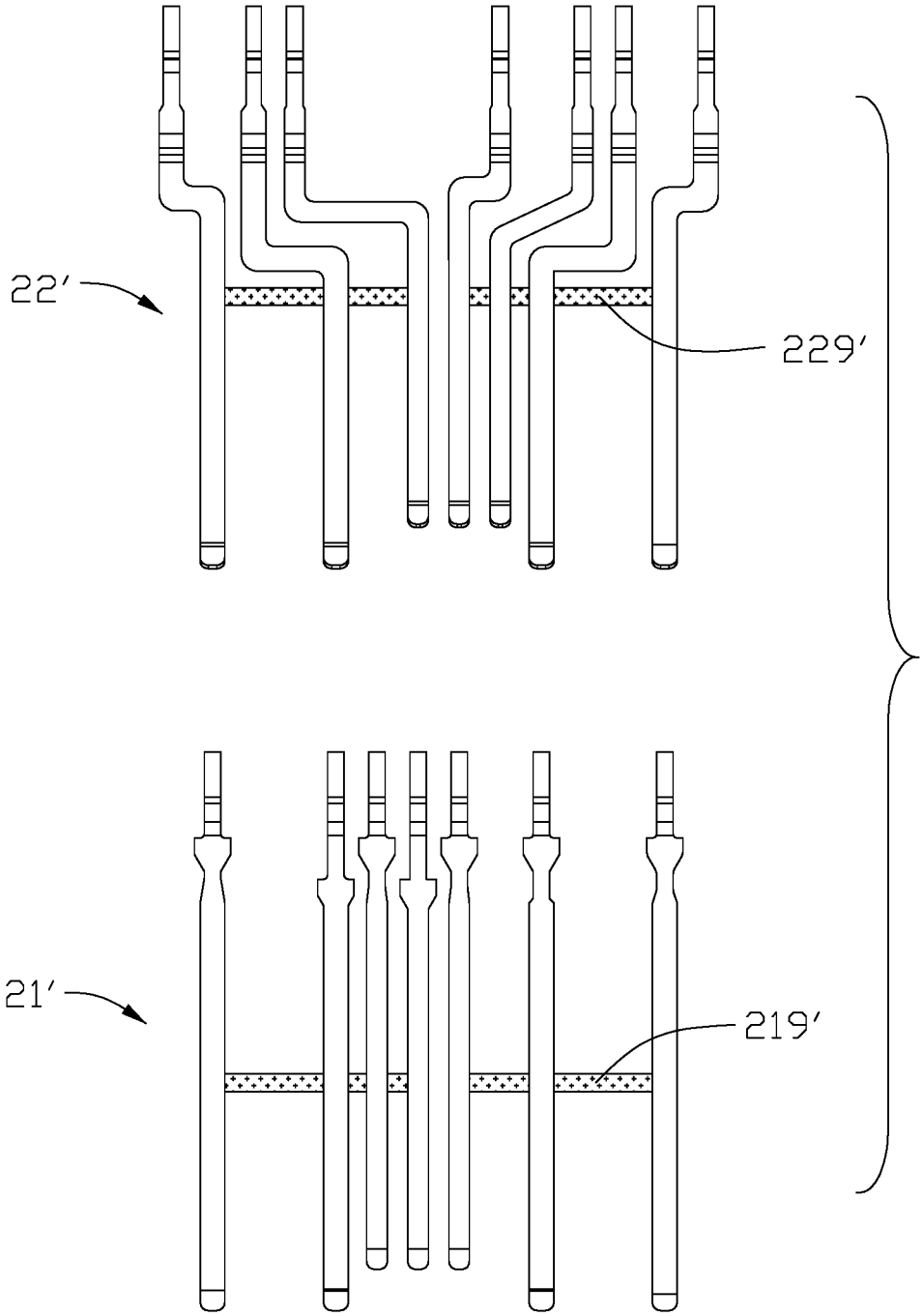
FIG. 17 is a plan view to show the first contacts and the second contacts both equipped with the bridges linked between the neighboring contacts according to another embodiment in which both the first contacts and the second contacts are simultaneously insert-molded with the shielding plate in the housing in the first stage insert-molding process.
Figure 18A:
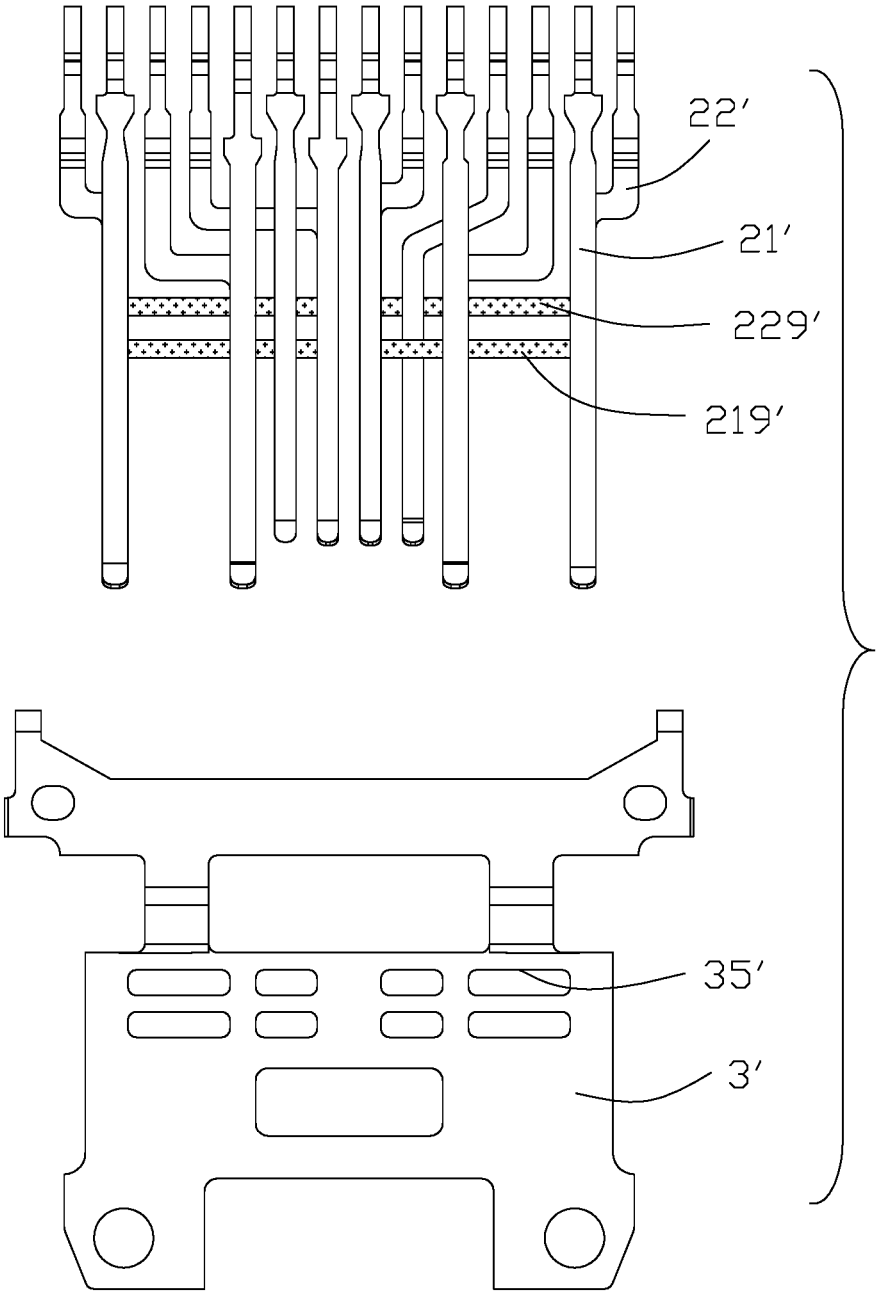
FIG. 18(A) is a plan (top) view to show the first contacts and the second contacts of FIG. 17 and the shielding plate used therewith.
Figure 18B:
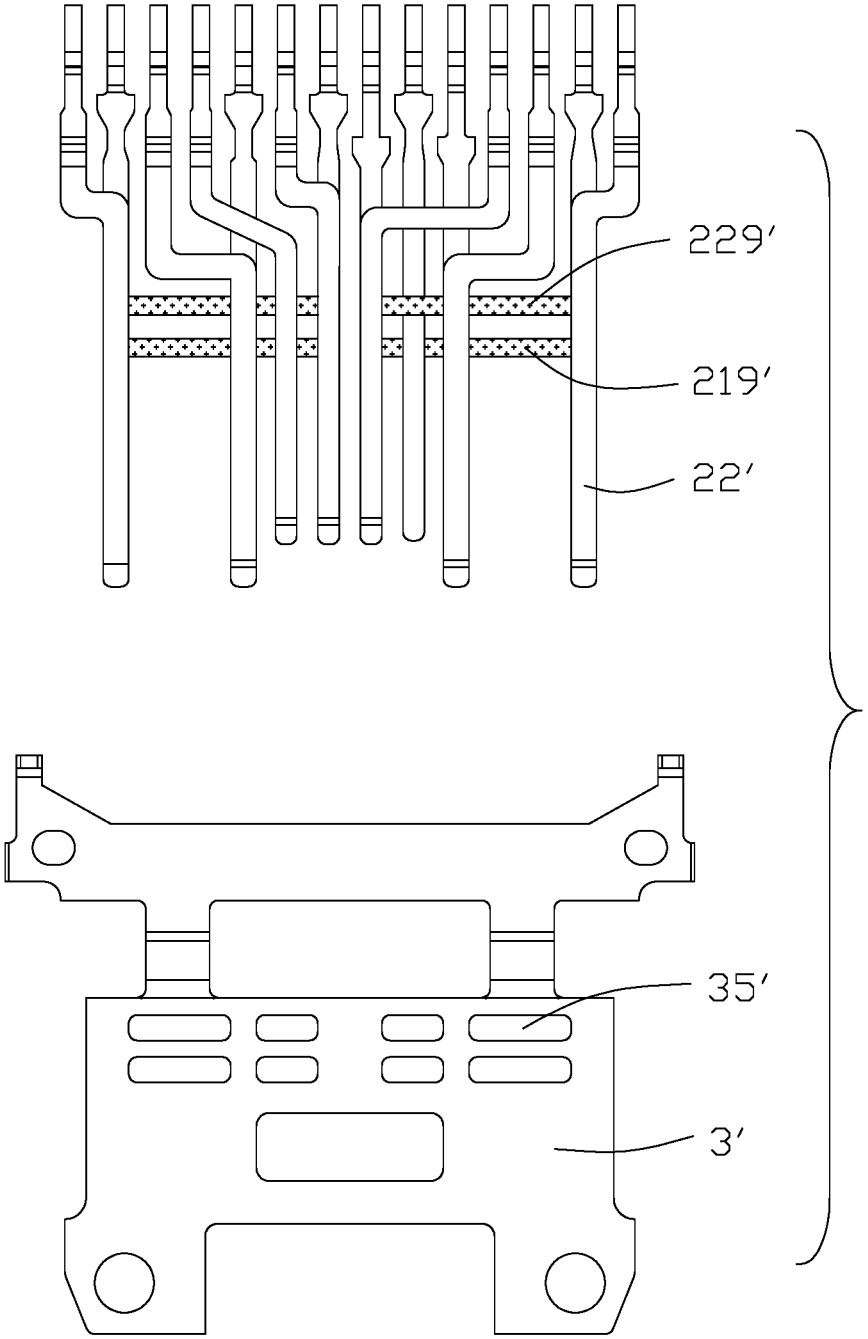
FIG. 18(B) is another plan (bottom) view of FIG. 18(A)
Figure 19A:
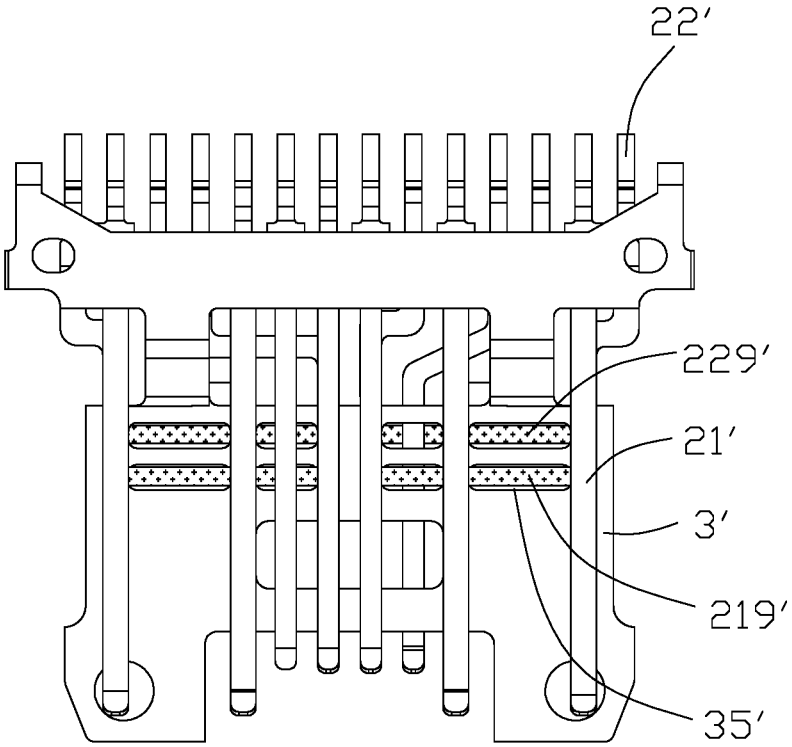
FIG. 19(A) is a plan (top) view to show the first contacts, the second contacts and the associated shielding plate of FIG. 18(A)
Figure 19B:
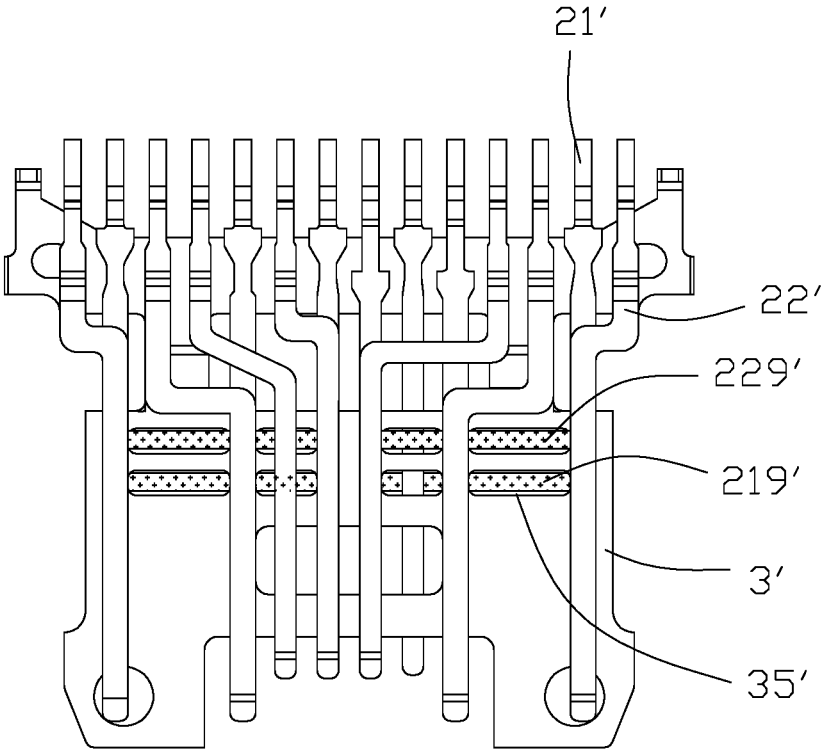
FIG. 19(B) is another plan (bottom) view to show the first contacts, the second contacts and the associated shielding plate of FIG. 19(A)
Figure 20A:
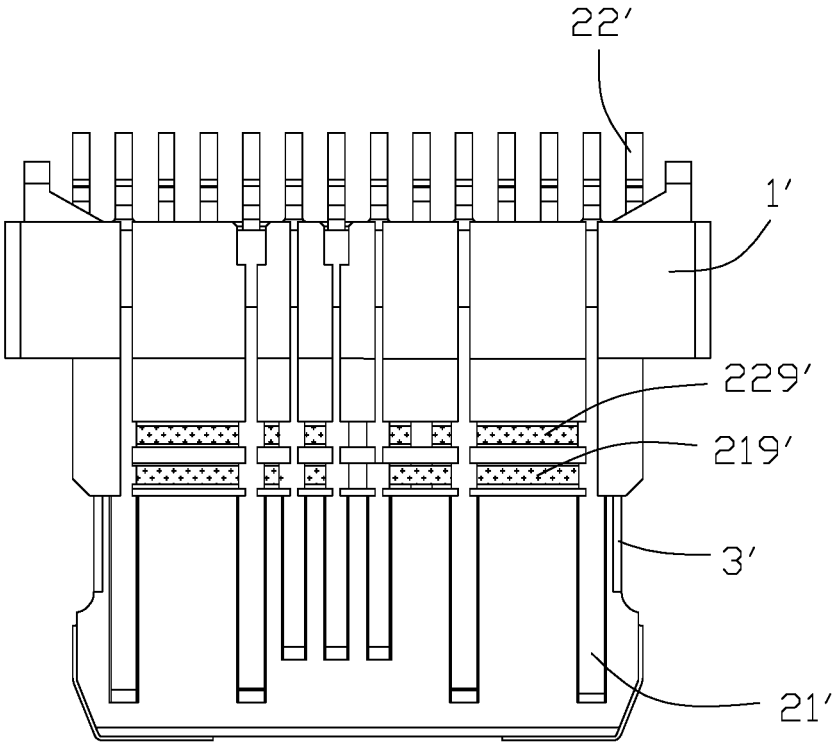
FIG. 20(A) is a plan (top) view to show an assembly including the first contacts, the second contacts and the associated shielding plate of FIG. 18(A) all integrally formed within the housing via an insert-molding process.
Figure 20B:
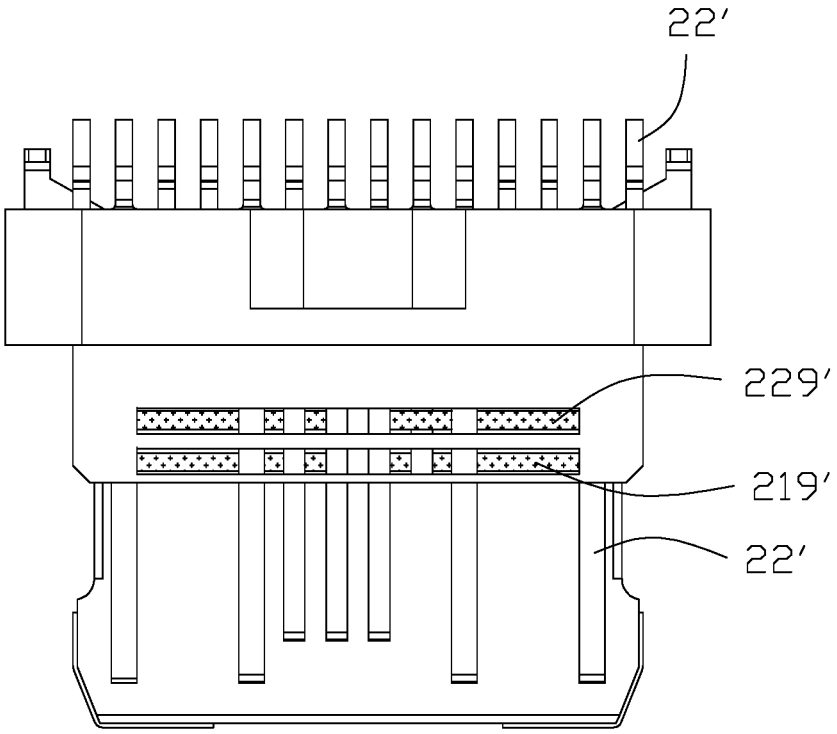
FIG. 20(B) is another plan (bottom) view to show the assembly of FIG. 20(A)
Figure 21A:
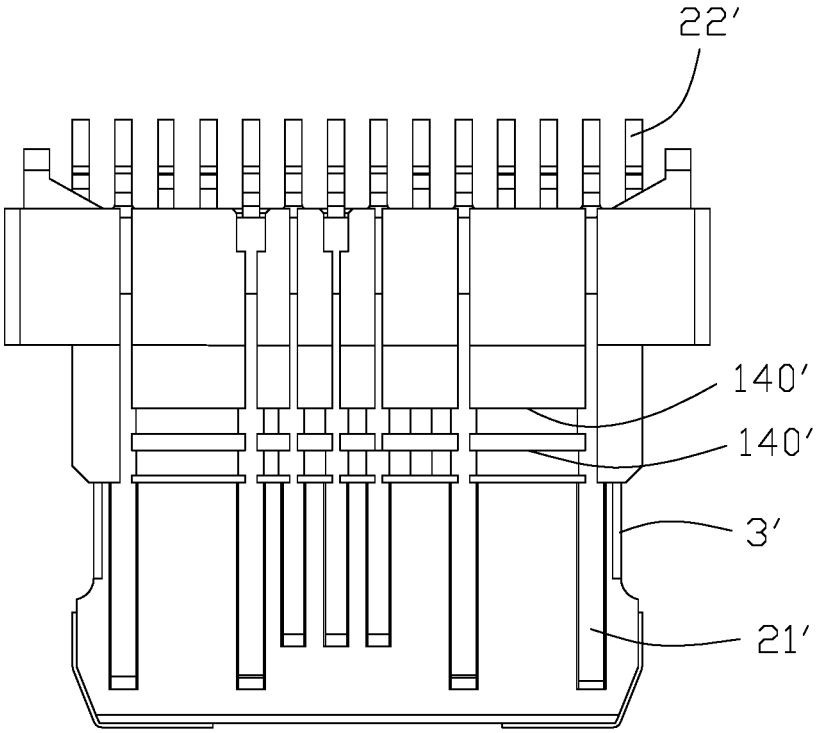
FIG. 21(A) is a plan (top) view to show the assembly of FIG. 20(A) after the bridges are removed therefrom.
Figure 21B:
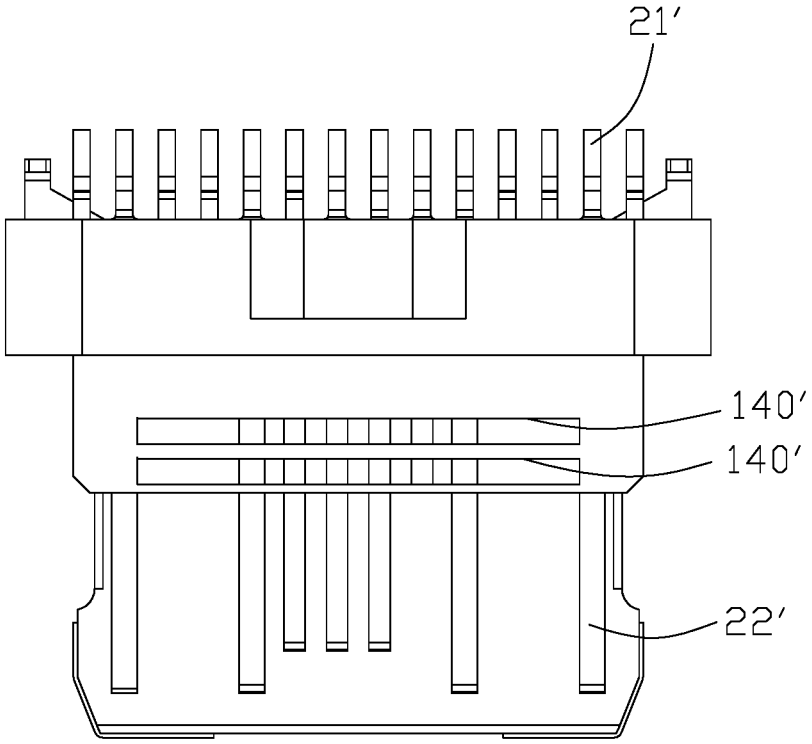
FIG. 21(B) is another plan (bottom) view to show the assembly of FIG. 21(A)

FIGS. 11-16(B) illustrate the relationship among the bridges 229, the openings 35 of the shielding plate 3, the through hole 140 of the connecting portion 14, and the insulative member 4. Notably, on one hand during the insert-molding process, the bridges 229 are aligned with both the openings 35 in the vertical direction; on the other hand after insert-molding process the through hole 140 is aligned with both the openings 35 and the corresponding bridges 229. Therefore, a puncher (not shown) may be inserted into the through hole 140 and the openings 35 to punch out the bridges 229 so as to have the corresponding second contacts 22 be independent and separate from one another structurally. Finally, the insulative member 4 is overmolded to the assembly so as to fill the through hole 140 and the openings 35 as shown in FIGS. 16(A) and 16(B) for finalize the whole connector assembly. It should be noted that the bridges 229 should be of the same material with the contacts 22 because they are stamped out from the same sheet metal. The reason that the bridges 229 are differently shown with dots thereon in the drawings, is for easy identification.

Figure 22:
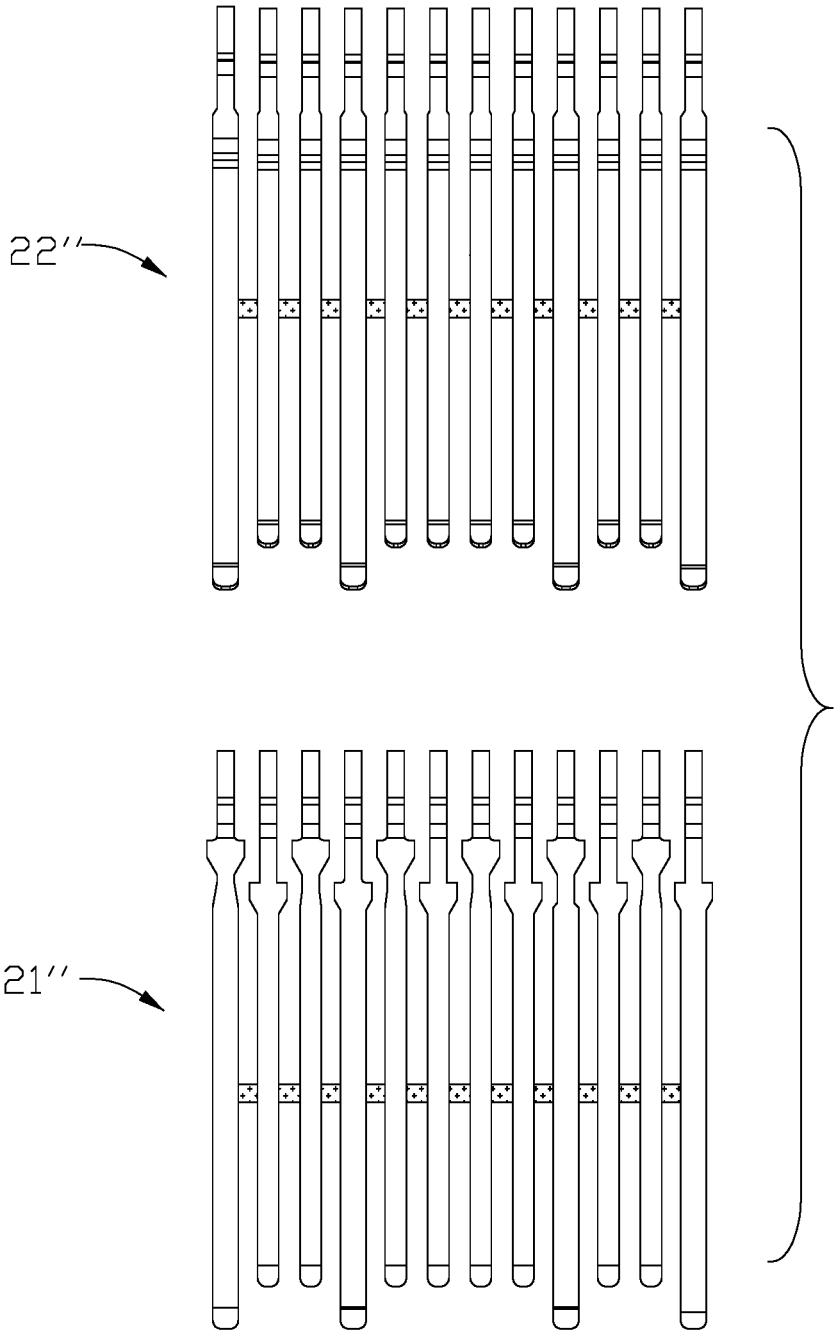
FIG. 22 is a plan view of the first contacts and the second contacts according to another embodiment.

FIGS. 17-21(B) show another embodiment with the spirit of the parent application Ser. No. 15/174,001 wherein all the first contacts 21', the second contacts 22' and the shielding plate 3' are insert-molded within the insulative housing 1' via a same insert-molding process. In this arrangement, the bridges 229' between the neighboring second contacts 22' should be offset from the bridges 219' between the neighboring first contacts 21' in the front-to-back direction for easy removal consideration without interference. Notably, the corresponding openings 35' in the shielding plate 3' and the corresponding through holes 140' in the housing 1' are also required to be formed in two rows spaced form each other the front-to-back direction to work with the offset bridges 219' of the first contacts 21' and the bridges 220' of the second contacts 22'. In this embodiment, all the first/upper bridges of the first/upper contacts are arrange in one row and all the second/lower bridges of the second/lower contacts are arranged in another row. Anyhow, the bridges may be arranged in an alternate manner in the front-to-back direction as long as no overlapping occurs in the vertical direction for no interference. The puncher for the bridges 219' and the puncher for the bridges 229' may be operated in an opposite manner along the vertical direction. Understandably, the structure of the slot 130 of the first embodiment may not be required in this embodiment. FIG. 22 shows another embodiment having the full number contacts in both first contacts 21" and second contacts 22", i.e., the equal and fine pitch arrangement of both the first contacts 21" and the second contacts 22" may also incorporate the shielding plate therebetween to be simultaneously integrally formed with the insulative housing via a same insert-molding process.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector comprising:

a plurality of contacts having a plurality of first contacts and a plurality of second contacts, each first contact having a first engaging section and each second contact having a second engaging section;

an insulative housing having a base portion, a tongue portion extending forwardly from the base portion, and a plurality of receiving grooves running through the base portion to the tongue portion in a front-and-rear direction, the tongue portion defining a first surface and a second surface opposite to the first surface in an up-and-down direction perpendicular to the front-and-rear direction, the receiving grooves exposed in the first surface and the second surface in the up-and-down direction; and a metallic shielding plate located between the first engaging sections and the second engaging sections; wherein the insulative housing, the second contacts, and the shielding plate are integrally formed together to form a contact module via an insert-molding process, while the first contacts are forwardly assembled to the receiving grooves once the contact module is formed; wherein the first contacts are exposed upon the first surface and the second contacts are exposed upon the second surface; and the base portion defines a plurality of slots connecting with the receiving grooves in the up-and-down direction and exposed to an exterior in the up-and-down direction.

2. The electrical connector as claimed in claim 1, further comprising an insulative member molded to a rear end of the contact module with the first contacts for fastening the first contacts.

3. The electrical connector as claimed in claim 2, wherein the insulative member includes a covering portion that fills the slots along the up-and-down direction and the receiving grooves along the front-and-rear direction.

4. The electrical connector as claimed in claim 3, wherein said insulative member presses the first contacts in the up-and-down direction.

5. The electrical connector as claimed in claim 1, wherein the insulative housing defines a through hole extending therethrough in the up-and-down direction, and the shielding plate defines a plurality of openings aligned with the through hole in the up-and-down direction so as to remove corresponding bridges which are originally respectively linked between every two neighboring second contacts and located in the through hole for facilitating said insert-molding process to form said contact module while being punched out once the contact module has been formed.

6. The electrical connector as claimed in claim 5, further comprising an insulative member molded to a rear end of the contact module with the first contacts for fastening the first contacts, wherein said insulative member fills the through hole and the corresponding openings.

7. The electrical connector as claimed in claim 6, wherein said through hole is formed around a root section of the tongue portion.

8. An electrical connector comprising:

a plurality of contacts having a plurality of first contacts and a plurality of second contacts, each first contact having a first engaging section and a first soldering section, and each second contact having a second engaging section and the second soldering section;

an insulative housing having a base portion, a tongue portion extending forwardly from the base portion, and a plurality of receiving grooves running through the base portion to the tongue portion in a front-and-rear direction, the tongue portion defining a first surface and a second surface opposite to the first surface in an up-and-down direction perpendicular to the front-and-rear direction, the receiving grooves exposed in the first surface and the second surface in the up-and-down direction;

a metallic shielding plate located between the first engaging sections and the second engaging sections; wherein the insulative housing, the second contacts, and the shielding plate are integrally formed together to form a contact module via an insert-molding process, while the first contacts are assembled to the insulative housing once the contact module is formed; wherein the engaging sections of the first contacts are exposed upon the first surface and the engaging sections of the second contacts are exposed upon the second surface; wherein the first soldering sections of the first contacts and the second soldering sections of the second contacts are aligned in one line along a transverse direction perpendicular to both said front-and-rear direction and said up-and-down direction;

the insulative housing defines a through hole extending therethrough in the up-and-down direction, and the shielding plate defines a plurality of openings aligned with the through hole in the up-and-down direction so as to remove corresponding bridges which are originally respectively linked between every two neighboring second contacts and located in the through hole for facilitating said insert-molding process to form said contact module while being punched out once the contact module has been formed; and an insulative member molded to the contact module with the first contacts for fastening the first contacts and filling the through hole.

9. The electrical connector as claimed in claim 8, wherein each of said first contacts further includes a first connecting section linked between the first engaging section and the first soldering section and disposed within the housing, each of said second contacts further includes a second connecting section linked between the second engaging section and the second soldering section and disposed in the housing, and the first connecting sections are straight while the second connecting sections are bent.

10. The electrical connector as claimed in claim 8, wherein the first engaging sections of the first contacts have unequal intervals between every adjacent two first engaging sections, the second engaging section of the second contacts have unequal intervals between every adjacent two second engaging sections while a combination of the aligned first soldering sections and second soldering sections have equal intervals between every adjacent two first soldering sections and second soldering sections.

11. An electrical connector comprising:

a plurality of contacts having a plurality of first contacts and a plurality of second contacts, each first contact having a first engaging section and each second contact having a second engaging section;

an insulative housing having a base portion, a tongue portion extending forwardly from the base portion, and a plurality of receiving grooves running through the base portion to the tongue portion in a front-and-rear direction, the tongue portion defining a first surface and a second surface opposite to the first surface in an up-and-down direction perpendicular to the front-and-rear direction, the receiving grooves exposed in the first surface and the second surface in the up-and-down direction;

a metallic shielding plate located between the first engaging sections and the second engaging sections, wherein the insulative housing, the second contacts, and the shielding plate are integrally formed together to form a contact module via an insert-molding process and the first contacts are forwardly assembled to the receiving grooves after the contact module is formed; and an insulative member molded to a rear end of the contact module with the first contacts for fastening the first contacts; wherein the first contacts are exposed upon the first surface and the second contacts are exposed upon the second surface;

the insulative housing defines a through hole extending therethrough in the up-and-down direction, and the shielding plate defines a plurality of openings aligned with the through hole in the up-and-down direction so as to remove corresponding bridges which are originally respectively linked between every two neighboring second contacts and located in the through hole for facilitating the insert-molding process to form said contact module while being punched out after the contact module has been formed; and the insulative member fills the through hole and corresponding openings.

12. The electrical connector as claimed in claim 11, wherein the through hole is formed around a root section of the tongue portion.

* * * * *